US005426909A

United States Patent [19]

Slocum, III

[11] Patent Number: 5,426,909

[45] Date of Patent: Jun. 27, 1995

[54] ITEM INSERTION APPARATUS FOR CONTAINERS

[76] Inventor: Richard W. Slocum, III, 200 Forest Trail, Nicholasville, Ky. 40356

[21] Appl. No.: 116,124

[22] Filed: Sep. 2, 1993

[51] Int. Cl.[6] ..... B65B 61/20

[52] U.S. Cl. ..... 53/50; 53/258; 227/67

[58] Field of Search ..... 53/50, 238, 237, 235, 53/258, 468, 141, 520; 227/67, 69, 76

[56] References Cited

U.S. PATENT DOCUMENTS

| | | | |
|---|---|---|---|
| 1,792,763 | 2/1931 | Ryan | 53/50 X |
| 4,286,513 | 9/1981 | Floyd et al. | 53/50 X |
| 4,658,564 | 4/1987 | Bell, Jr. et al. | 53/50 X |
| 4,687,465 | 8/1987 | Prindle et al. | 227/67 X |
| 5,079,901 | 1/1992 | Kotsiopoulos | 53/520 X |
| 5,115,957 | 5/1992 | Smith et al. | 227/67 |
| 5,323,587 | 6/1994 | Amaranti | 53/258 X |

*Primary Examiner*—James F. Coan
*Attorney, Agent, or Firm*—Gilliam & Stockwell

[57] ABSTRACT

An apparatus for inserting an item into a closed container includes a body and an implement for forming an entrance point into a surface of the closed container. The implement takes the form of a blade member, or a rotary member having saw-teeth or cutting abrasive on a leading edge thereof. A delivery passage is associated with the implement so the item may be delivered therethrough into the hole formed in the wall of the container by the implement. The apparatus has a stacked magazine feed. Alternatively, the items are fed on a carrier web and punched or severed from the carrier web to be placed in position for delivery. The item is forced through the delivery passage with a ram member that is driven by air pressure or a solenoid. For containers that have a pre-formed slit or opening, the apparatus has a projection that slides into the opening. The delivery passage extends through the length of the projection to provide a pathway to deliver the item after the projection has been slid into the pre-formed slit or opening. The apparatus uses similar components to insert an item by free-fall into an open container situated below.

53 Claims, 13 Drawing Sheets

ITEM INSERTION APPARATUS FOR CONTAINERS

TECHNICAL FIELD

The present invention relates to packaging systems and, more particularly, to an apparatus for inserting items such as labels or electronic article surveillance (EAS) security "targets" into closed cartons, packages or other similar containers.

BACKGROUND OF THE INVENTION

Many articles are placed in cartons or like containers in preparation for sale at a retail site. Thus, many manufacturing facilities incorporate a packaging station as part of their production operation. The product normally dictates the mode of packaging, which can involve either manual labor or advanced machinery. In addition, many of the cartons have labels applied which include indicia for identifying the product in the container and its characteristics.

In a mass production setting many machines used for inserting items or applying labels incorporate some type of "pick-and-place" operation. More specifically, a moving number associated with the machine picks an item from a feedstock supply and transports the item to be placed on the surface of the package.

In addition to applying labels at the manufacturing facility, packaged products are also similarly handled at the retail outlet or supplying distribution center. Hand-held labelers are usually used in these settings. These devices generally operate with bulk-supplied labels that are releasibly adhered to a carrier web. They function by delaminating or separating the label from the carrier web and then affixing the label to the surface of the container.

Often the labeling process functions to incorporate an EAS security target to the surface of a container to facilitate protection against theft. It can be appreciated that application of such an item to the outside surface of a container does not present a fool-proof solution since the labels may be surreptitiously removed or otherwise compromised by a thief before passing through a security detector. It is easily seen that a much more reliable system entails placing such a security target within the closed container receiving the article. This requires a device that is of appropriate size and configuration to slip into an existing opening of the container to introduce the security target to the enclosed inner compartment. Alternatively, with containers lacking an access point, the procedure necessitates a device that forms a hole or slit in a wall of the container to then allow the introduction of the target therein. The applicant is unaware of any device that performs either of these functions.

A need is thus identified for an apparatus that is capable of inserting items into a closed container. The apparatus needed for addressing this problem should be capable, in its various embodiments, of operating in both a mass production setting and on individual containers at a retail site or distribution center. Each of its various embodiments should be of such design promote the ability to accomplish the insertion objective in each of its operational environments.

SUMMARY OF THE INVENTION

Accordingly, it is the primary object of the present invention to provide an apparatus that is capable of inserting small items such as labels or security targets into a closed package.

It is an additional object of the present invention to provide an apparatus that facilitates the insertion of items into a closed carton by forming an opening in the carton and substantially simultaneously inserting the item through the opening.

Still another object of the present invention is to provide an apparatus for simplifying the insertion of items into a package by eliminating much of the mechanical motion associated with pick-and-place machinery.

It is a further object of the present invention to provide an apparatus that is capable of inserting objects into closed packages in a mass production setting at high speed and without manual handling.

Still another object of the present invention is to provide an apparatus that facilitates the insertion of items through an existing slit or similar opening of a closed package.

It is an additional object of the present invention to provide an apparatus that is easy to use in a retail or distribution center setting and whose operation can be readily performed by unskilled labor.

A further object of the present invention is to provide an apparatus that reliably and efficiently introduces items or security targets into a closed container.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a novel apparatus for solving the problems associated with inserting items into a closed container is provided. The apparatus includes a body that houses the operative components for the invention. Specifically, means are associated with the body for accessing the interior of the closed container. A delivery passage which provides a pathway for the item into the container cooperates with the accessing means.

There is also provided a means for feeding the item into the delivery passage in readiness for insertion. A means for delivering the item is then actuated to propel the item through the delivery passage into the container. The operable components may be incorporated into a machine that is automatically operated at high speed at a packaging station on a production assembly line or, alternatively, may be adapted for a hand-held tool that is manually operable by unskilled laborers on individual containers at point-of-sale establishments, or their supplying distribution centers.

Many containers at the present time are completely sealed, with no opening formed therein, after an article is placed therein during packaging. In order to operate on this type of container, the inventive apparatus includes an implement for forming an entrance point into the interior of the closed container. In one embodiment of the invention, the implement comprises a blade member mounted within the body of the apparatus for translational motion. The blade member within this embodiment is defined by a cutting edge configured to form a substantially complete void through a wall of the container and into its interior. The preferred embodiment of the blade member includes a unique design that facilitates its cutting function through the wall of the container.

More specifically, the blade member has a cutting edge defined by a plurality of connected linear sides, with a first two opposing sides being longer than a second two opposing sides. Thus, the cutting edge preferably has a generally rectangular configuration.

In order to promote the cutting action, the connected linear sides of the cutting edge cooperate to present a plurality of points for initial contact between the blade member and the wall of the container. Desirably, the cutting edge is designed to provide at least two points in different horizontal and vertical planes with respect to each other.

In a particular preferred embodiment, a first of the longer sides of the cutting edge tapers inwardly at the same angle from opposing outer points to meet at a common point along the central longitudinal axis of the blade member. A second of the longer sides, which opposes the first side, tapers outwardly at the same angle from opposing outer points to also meet at a common point along the central longitudinal axis of the blade member. The third and fourth sides connect the first and second sides.

The blade member may alternatively be designed to provide a cutting edge configured to form a flap, rather than a complete void, through the container wall. The cutting edge is also defined by a plurality of connected linear sides. However, in this alternative design, two of the linear sides are connected to only one linear side. Thus, this pattern defines a U-shaped cutting edge which operates to create a U-shaped slit in the container wall. With the design, the linear sides cooperate to present at least one point for initial contact with the container wall to assist with the cutting action.

While the cutting edge designs of the above-described blade members are defined by a generally rectangular or U-shaped configuration, no limitation is contemplated in that regard. The cutting edge may be formed with any of a variety of other geometrical shapes, including those with curvilinear lines, such as circular or elliptical contours.

In a preferred embodiment, the blade member is selectively extendable to penetratingly engage a wall of the closed container. Thus, the blade member is safely held within the body when not in operational use. In this embodiment, the blade member is removably coupled to a drive member. To facilitate this function, the blade member has at least one hole for receiving a cooperating projection on the drive member. In order to promote selective removal, the inventive apparatus further has a removable retaining element attached to the body that, when removed, allows access to the blade member and the drive member. This is typically accomplished through the use of opposing blocks that are attached to the body by removable connectors.

Since the blade member is selectively extendable, the drive member is part of a means for displacing the accessing means. The preferred embodiment contemplates the displacing means as being pneumatic actuating means. This desirably takes the form of a conduit positioned in a chamber within the body and establishing fluid communication between a pneumatic source and the drive member associated with the blade member. In order to allow return/resetting of the blade member into the body, a relief passage associated with the chamber is provided.

In an alternative embodiment, the displacing means comprises electromechanical actuating means. The alternative embodiment contemplates the use of a solenoid element to move the drive member.

In a further aspect of the inventive apparatus, there is provided a means for holding the body against the closed container. This is preferably effected by suction means. The preferred design utilizes a surface cavity on the body. The cavity is exposed to a wall of the container, and negative pressure is applied therein. The cavity can be segmented to better hold irregularly shaped containers. The cavity can alternatively receive a conduit establishing fluid communication between a suction source and the container wall.

The feeding means of the preferred embodiment utilizes a vertical receptacle having a stack of items for disbursement. This type of feeding mechanism is typically referred to as a feed clip or magazine. The items feed by spring-pressure operation into the delivery passage with the preferred configuration.

Additional alternative feeding mechanisms are contemplated. The alternative feeding mechanisms generally utilize a movable carrier web on which a plurality of items are adhered in adjacent relation; most security targets are furnished in this fashion by their manufacturer. The first alternative feeding mechanism utilizes a punch member that detaches the item from the carrier web. Once the punch member has actuated to drive the item into the delivery passage, the punch member forms a portion of a side of the delivery passage. In a second alternative design, a cutting member detaches the item from the carrier web once it is rolled into position in the delivery passage. As with the punch member, the cutting member forms a portion of a side of the delivery passage after detaching the item from the web.

There are a variety of means that may be employed to deliver the item to the container once it is fed to the delivery passage. The use of positive air pressure to simply blow the item through the passage and into the container is one contemplated approach. A more desirable concept involves the use of a ram member displaceable within the delivery passage. Positive air pressure is introduced into the delivery passage to cause the displacement of the ram member.

Alternatively, the ram member is driven by electromechanical means. As with the alternative actuation of the drive member described above, a solenoid element is the desirable component for performing the electromechanical function. A means for returning the ram member to a home position following delivery of a first item and in preparation for a next successive item is preferably provided regardless of the actuating mechanism. This generally takes the form of a compression spring that biases the ram member back to its home position after it has been actuated to operate on the item in the delivery passage.

Some containers are formed of material of such thickness that the blade member does not accomplish the goal of forming an entrance point in the container wall. The inventive apparatus contemplates an alternative implement to operate on such containers. The preferred implement in this setting is a rotary member having a cutting element on a leading edge thereof. The rotary member is received within an annular chamber surrounding the delivery passage.

In order to perform its function, the rotary member is operatively driven by rotatable driving means. In the preferred embodiment, the rotatable driving means comprises at least one contact wheel frictionally engaging the rotary member and driven to rotate by a motor. The contact wheel is supported by a shaft mounted between support blocks. The shaft is mounted with cooperating bearings to allow it to rotate when driven by the motor.

The inventive apparatus further includes means for holding the rotary member within the body. In the preferred embodiment, the holding means comprises a combination, using a means for holding the central axis of the rotary member in a substantially fixed position and a means for holding the rotary element in a substantially fixed axial position. Preferably, the central axis retaining means takes the form of at least one spatially fixed member that rotates about an axis non-coincident with the central axis of the rotary member. In the particular preferred embodiment, the spatially fixed member comprises a plurality of retention wheels in opposing relation to the contact wheel. A support shaft supports the retention wheels and is mounted between support blocks using associated bearings. Furthermore, the axial retaining means comprises an annular flange formed on an outer circumference of the rotary member and received within a slot formed within the body.

In an alternative embodiment, the rotatable driving means may take the form of a motor with an associated shaft and a gear assembly associated with the shaft and the rotary member.

In order to prevent the rotary member from slipping laterally on the contiguous wall of the container, means is provided for holding the body against the container. This preferably takes the form of at least one needle that pierces the container wall for retention.

Some containers, such as 20-pack cigarette cartons, do not require an entrance to be formed in a wall thereof. These cartons already have a slit or opening into which an accessing means may be slid. In order to operate on these cartons, the inventive apparatus is designed to include a projection extending from the front face of the body. A delivery passage extends through the projection. The projection includes a rearwardly tapered tip to allow it to easily slide between flaps of the container or into any other type of preformed opening.

The apparatus is capable of modification within the scope of the inventive concept to be employed to insert an item by free-fall into an open container situated below. In this setting, the apparatus comprises a body with an associated delivery passage that is directed to an open side of the container. The apparatus also incorporates a means for feeding the item to the delivery passage. In the preferred embodiment, a means for assisting the free-fall of the item into the container is also provided. Further, in the particular preferred embodiment, a means for controlling the assisting means and feeding means is incorporated in the apparatus.

In this working environment, the feeding means typically comprises a movable carrier web on which a plurality of items are adhered in adjacent relation. A punch member is provided for detaching the items from the carrier web. Preferably, the punch member forms a portion of a side of the delivery passage after detaching an item from the web.

As is the case with related functions described above, this design contemplates the use of positive air pressure as the assisting means. More particularly, positive air pressure is directed into the delivery passage to propel an item towards the container. A port is provided in the body to allow air pressure release.

The controlling means for this embodiment comprises a programmable controller cooperating with a plurality of sensors. Desirably, one sensor is utilized to sense the presence of an item traveling through the delivery passage. Typically, a photocell having a light source and a photoreceptor is used to detect the passage of an item. Additionally, the preferred embodiment uses a sensor to sense the presence of a container positioned underneath the body. Preferably, an ultrasonic detector is used to preform this function.

Still other objects of the present invention will become apparent to those skilled in this art from the following description wherein there is shown and described a preferred embodiment of this invention, simply by way of illustration of one of the modes best suited to carry out the invention. As will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing, incorporated in and forming a part of the specification, illustrates several aspects of the present invention and together with the description serves to explain the principles of the invention. In the drawing.

Figure 1:
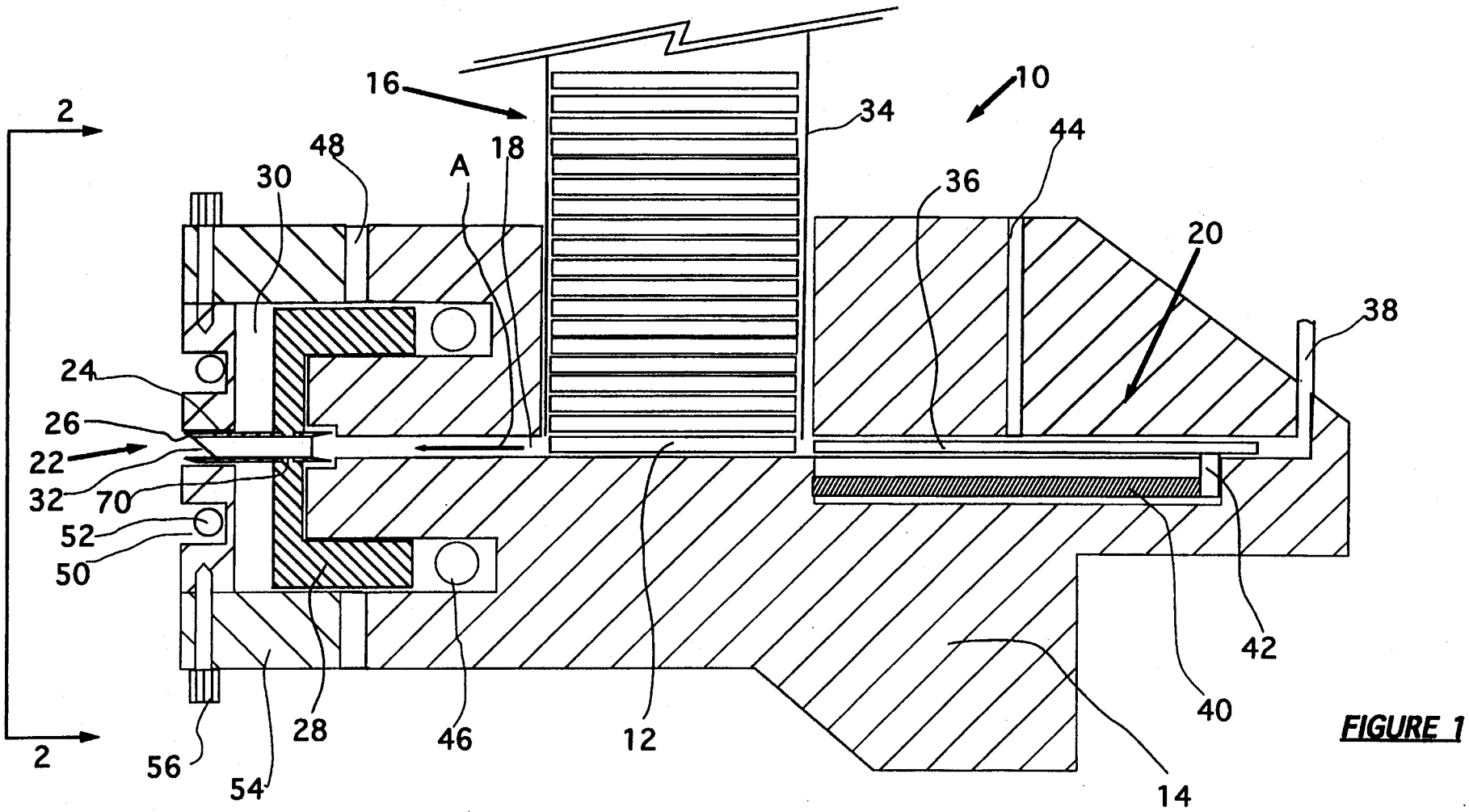
FIG. 1 is a side view in cross-section showing the operational components of the preferred embodiment of the present invention.

Reference will now be made in detail to the present preferred embodiment of the invention, an example of which is illustrated in the accompanying drawing.

DETAILED DESCRIPTION OF THE INVENTION

An insertion apparatus 10 constructed in accordance with the teachings of the present invention is used to insert an item 12 into a closed container (not shown). The apparatus 10 is particularly useful in inserting relatively light, thin labels into sealed packages.

Without limiting its application, it is specifically contemplated that the inventive apparatus 10 handle the type of label that acts as an electronic article surveillance target. An example of such an item is the UltraMax TM electronic article surveillance label target manufactured by Sensormatic Electronics Company of Deerfield Beach, Fla. The insertion apparatus 10, in its various embodiments, is capable of delivering an item 12 into a closed container either when packaging the article or at the retail site or distribution center. It is recognized that placing such targets within the interior of a container substantially eliminates the possibility of its removal therefrom. Consequently, the use of the apparatus 10 substantially enhances the ability to protect against theft of small and intermediate sized packages that are hidden by shoplifting thieves.

The apparatus 10 includes a body 14 that houses the operational components of the invention. For use in a retail environment, the inventive apparatus 10 is manufactured in a size and configuration that facilitates easy manual operation. A convenient configuration is in the shape of a shooting mechanism. In this configuration, the user manually handles the apparatus 10 and accomplishes insertion with the appropriate finger action or a triggering mechanism. Alternatively, it is within the scope of the invention to incorporate the appropriate control mechanisms to allow automatic operation through sensing the appropriate instant to initiate the insertion action and providing the appropriate initiation signal.

In addition, the basic concept of the invention can be incorporated into a machine that operates automatically and swiftly at a high speed packaging station on a production line. By operating singly or in multiple units, the inventive apparatus 10 is capable of processing a large volume of cartons at a manufacturing facility.

In addition, the basic concept of the invention can be incorporated into a machine that operates automatically when a container is pressed against the machine. Such a machine may be fixed at an "insertion station" in a warehouse or similar distribution center, and facilitate rapid insertion operation without requiring hand-manipulation of the inventive apparatus.

In its most general aspects, the apparatus 10 includes a feed mechanism (generally referred to as 16) that directly or indirectly feeds an item 12 into a delivery passage 18 located within the body 14. The delivery passage 18 is preferably shaped to basically coincide with the shape of the item 12 to be inserted in the container. The delivery passage 18 is most desirably rectangular in cross-section. A delivery mechanism (generally referred to as 20) then propels the item 12 through the delivery passage 18 and into the container.

Many merchandising containers lack an access point into the interior after sealing with an article therein. The inventive apparatus 10 handles these containers by incorporating a means to create an entrance point into the interior of the container.

The embodiment illustrated in FIG. 1 shows an accessing means that is operable on containers having relatively thin walls. More particularly, this embodiment is suited for containers made of thin molded plastic or paperboard. The accessing means depicted in this embodiment forms one of the key aspects of the inventive insertion apparatus 10. The preferred accessing means 22 for this operational environment utilizes a blade member 24 with a leading cutting edge 26. The blade member 24 is attached to cooperating drive blocks 28 that drive the blade member to extend for operation. The drive blocks 28 reside in an interior chamber 30 that accommodates translational motion.

The blade member 24 is depicted in FIG. 1 in a home position within the interior of the body 14 so that the cutting edge 26 is not exposed. In operation, the drive blocks 28 are driven forward within the interior chamber 30, forcing the connected blade member 24 to extend out of the body 14 to penetrate the container wall and create an entrance point into the interior of the container. The drive blocks 28 are preferably biased to promote the return of the blade member 24 to the home position after it has performed its cutting function and the item has been inserted.

Figure 2:
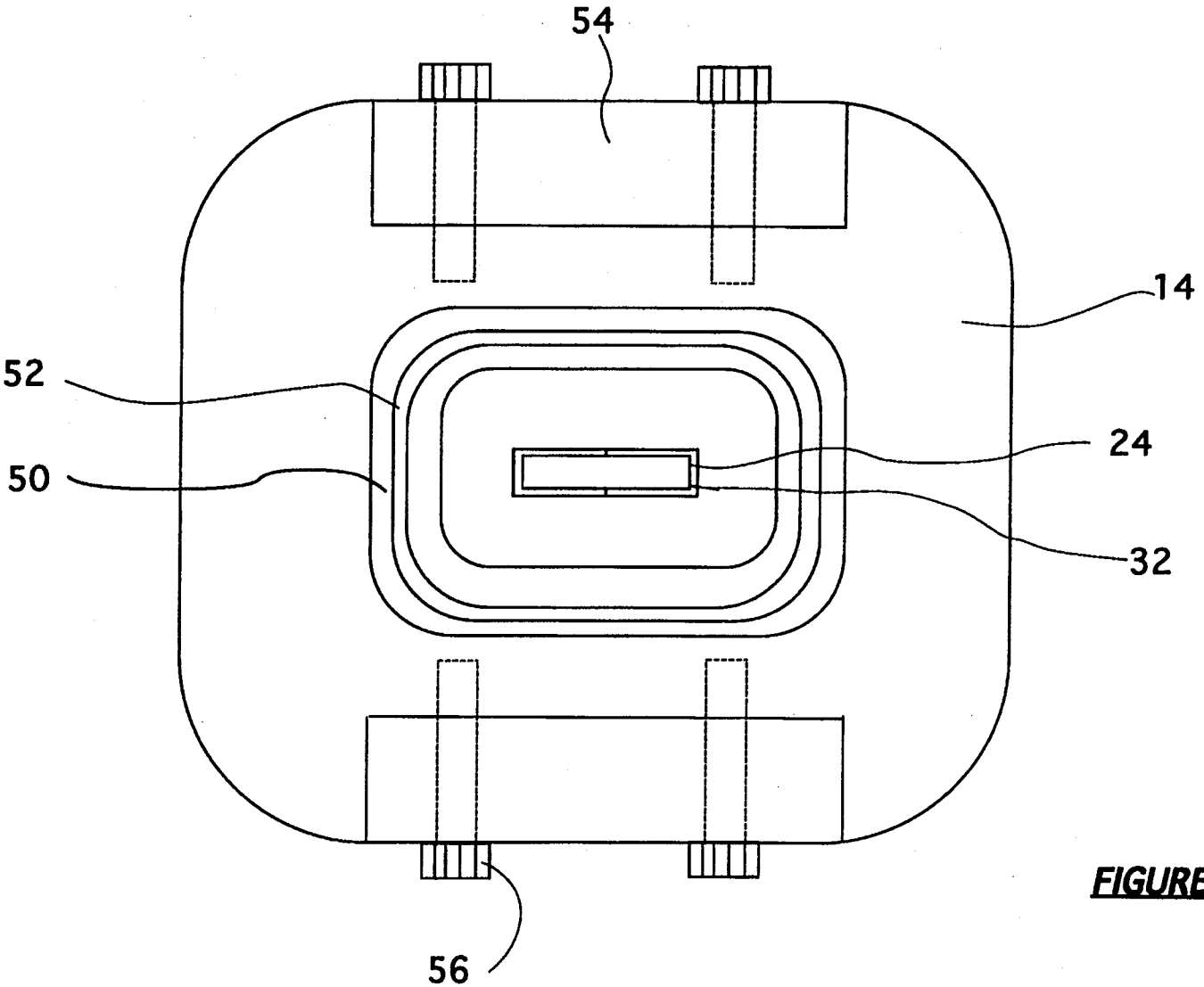
FIG. 2 is a view of the front face of the body of the present invention taken along lines 2—2 in FIG. 1.

As shown in FIG. 2, the blade member 24 preferably has a rectangular configuration so as to present a rectangular cutting edge 26 for operation. As a result of this configuration, the blade member 24 has a bore 32 that is aligned with the delivery passage 18. The rectangular opening formed in the container by the blade member 24 configured in this manner is most suitable to receive the label or item to be inserted. Accordingly, once the blade member 24 forms the entrance point in the closed container, an item 12 can be delivered through the continuous pathway defined by the delivery passage 18 and aligned bore 32 into the closed container.

The feed mechanism 16 preferably takes the form of a feed clip or magazine 34 containing a stacked column of items 12. The lowermost item 12 drops into the delivery passage 18 in preparation for delivery. Furthermore, the delivery mechanism 20 preferably takes the form of a ram 36, that, when actuated, propels the item through the delivery passage 18 and the bore 32 into the container.

The ram 36 is shown in its home position in FIG. 1. Preferably, an air conduit 38 is in fluid communication with the delivery passage 18 and leads from an air source (not shown). With this design, positive air pressure is applied through the air conduit 38. This transmits a force on the ram 36 in the direction of action arrow A in FIG. 1. The ram 36 engages the item 12, propelling it along the delivery passage 18.

The ram 36 is preferably connected to a spring 40 by a pin 42. The spring 40 acts to bias the ram 36 to its home position after the motive air pressure is released. Once the ram 36 is retracted to its home position, the lowermost item 12 in the magazine 34 drops into place in the delivery passage in preparation for delivery into the next closed container. A relief passage 44 communicates with the delivery passage 18 to provide an exhaust path for the gas applied to drive the ram 36.

While the ram 36 is considered as the most efficient delivery mechanism 20, alternatives within the scope of the invention may be utilized. More specifically, an electromechanical driving mechanism such as a solenoid is also contemplated for initiating the driving action of the ram 36. In accordance with standard operation of a solenoid, upon energization, the ram 36 is forced to translate within the delivery passage 18 to properly propel the item 12. Alternatively, it is contemplated that the ram 36 may be completely eliminated and positive air pressure from the air source be introduced through the air conduit 38 into the delivery passage 18 to itself provide the motive force for the item 12 therethrough.

This embodiment of the inventive apparatus 10 also contemplates that the drive blocks 28 are driven by positive air pressure. Preferably, the positive air pressure is introduced through a supply conduit 46 in fluid communication with the drive blocks 28. Accordingly, when air pressure is transmitted through the supply conduit 46, the drive blocks 28 are forced to translate within the interior chamber 30 to extend the blade member 24. Release slots 48 are provided in similar fashion to the relief passage 44 to allow air entering through the supply conduit 46 to bleed away.

In order to prevent the body 14 from slipping against the container during operation, or to minimize the possibility of the container wall "collapsing" due to the drive force of the blade member 24, the apparatus 10 preferably includes a surface cavity 50 that is exposed to the closed container and through which suction is drawn to hold the container against the body. The cavity 50 surrounds the blade member 24 (see FIG. 2) to ensure a grip around the blade member in preparation for operation. Preferably, suction is drawn through a suction conduit 52 in which the appropriate openings are formed so that the negative air pressure can properly act against the wall of the closed container. The cavity may be segmented to better accommodate irregularly shaped containers.

In order to enhance the efficiency of the insertion apparatus 10, the blade element 24 is removable so that the cutting edge 26 can be sharpened or the blade member discarded when it becomes irreparably damaged. To facilitate this ability, and as shown in FIGS. 1 and 2, the body 14 is formed with opposing keeper blocks 54. The keeper blocks 54 are connected to the body 14 with standard removable connectors such as threaded bolts 56. When the bolts 56 are unthreaded from their position, the keeper blocks 54 are removed, allowing access to the drive block 28/blade member 24 assembly. The blade member 24 may then be removed from the drive blocks 28 as will be detailed below.

Figure 4:
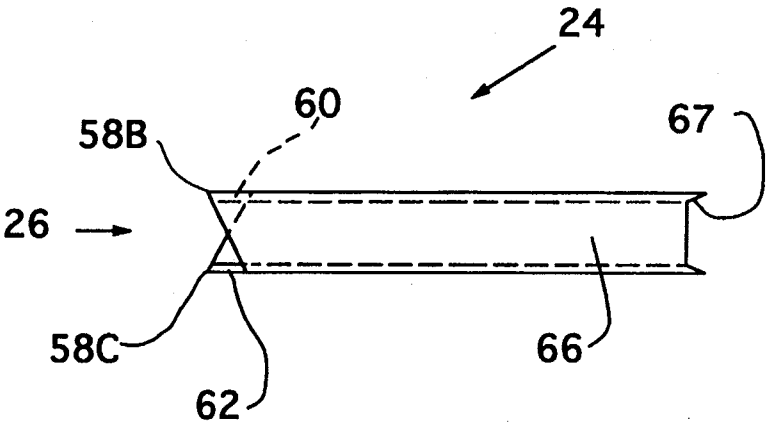
FIG. 4 is a side view of the blade member shown in FIG. 3.
Figure 3:
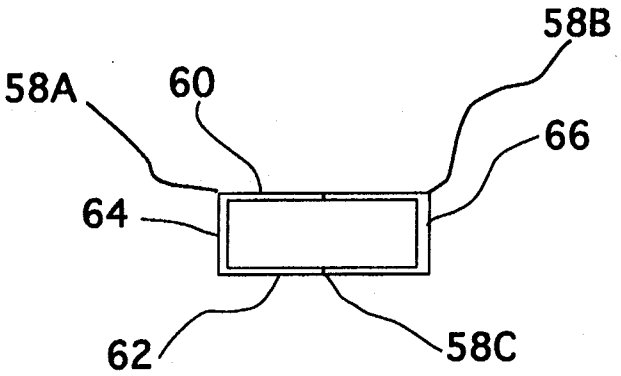
FIG. 3 is a front view of the preferred blade member utilized in the apparatus of the present invention.
Figure 5:
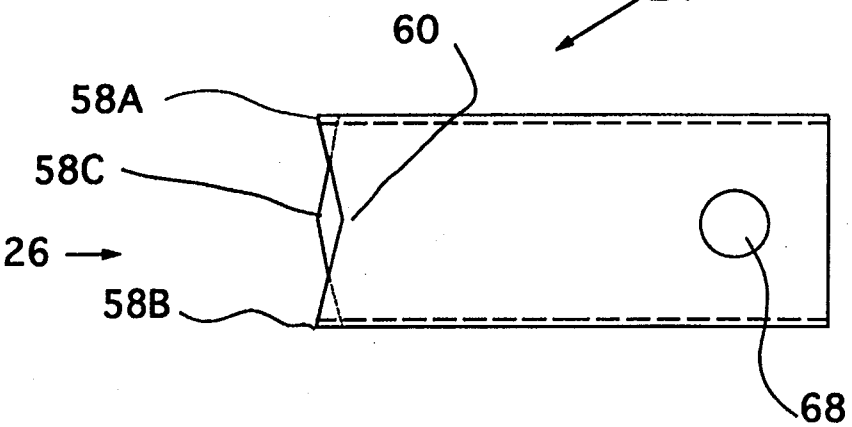
FIG. 5 is a top view of the blade member shown in FIGS. 3 and 4.

FIGS. 3–5 best illustrate the preferred design for the cutting edge 26 of the blade member 24. In order to facilitate the cutting ability, the cutting edge 26 is formed with a plurality of points 58A–C to piercingly engage the wall of the container. The points 58A–C are formed as a result of the slanted and tapered linear sides of the cutting edge 26. The cutting edge top side 60 is formed with a linear concavity. More particularly, the side 60 slants inwardly at a common angle from opposing outer points to a common point along the central longitudinal axis of the blade member 24. The cutting edge bottom side 62 is formed with a linear convexity. More specifically, the side 62 slants outwardly at a common angle from opposing outer points to a common point along the central longitudinal axis of the blade member 24. Cutting edge vertical sides 64 and 66 slant upwardly and forwardly from the bottom side 62 to the top side 60 in connecting relation.

As can be recognized from FIGS. 4 and 5, the leading point 58C formed on the bottom side 62 is in the same transverse vertical plane as the outer points 58A and 58B formed on the top side 60 of the cutting edge. Furthermore, with reference to FIG. 3, points 58A and 58B are in different longitudinal horizontal and vertical planes with respect to point 58C. Accordingly, upon initial contact between the blade member 24 and the closed container, engagement occurs simultaneously at three different points. The angles on the respective sides 60–66 enhance the cutting ability of the cutting edge 26, promoting a slicing action through the wall of the container.

Ideally, the blade member 24 cuts cleanly through the wall and the momentum of the blade member forces the cut plug into the interior of the container. In the event the plug remains connected by a few fiber strands or, more likely, the plug travels into the bore 32, the force of the item 12 propelled against the plug is sufficient to separate the remaining strands and/or push the plug into the container in advance of its own entry.

As best shown in FIG. 4, the blade member 24 has a trailing edge 67 that slants downwardly and forwardly from the outermost points. This configuration assists in reliable delivery of the item 12 through the bore 32. The tapered edge 67 guides the item 12 from the delivery passage 18 directly into the bore 32 as it travels toward the container.

The blade member 24 also preferably has a hole 68 formed adjacent the trailing edge 67 on each of the top side 60 and bottom side 62. The holes 68 receive cooperating projections 70 formed on the drive blocks 28 (see FIG. 1). Accordingly, the blade member 24 is easily removed from the drive blocks 28 once access is obtained thereto by removing the keeper blocks 54 as described above.

Figure 7:
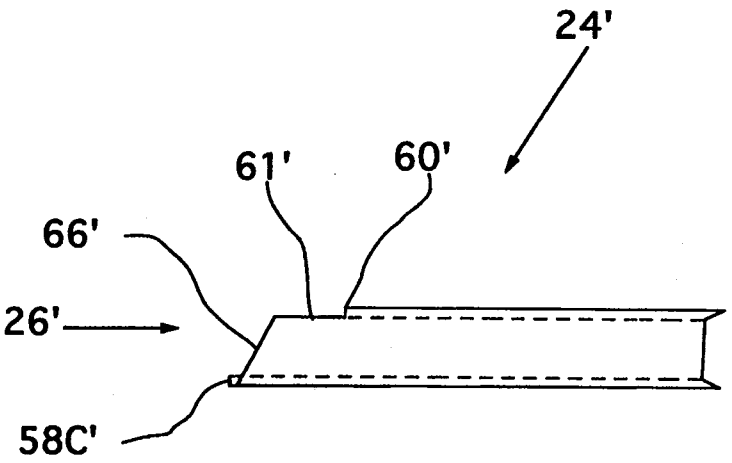
FIG. 7 is a side view of the blade member shown in FIG. 6.
Figure 8:
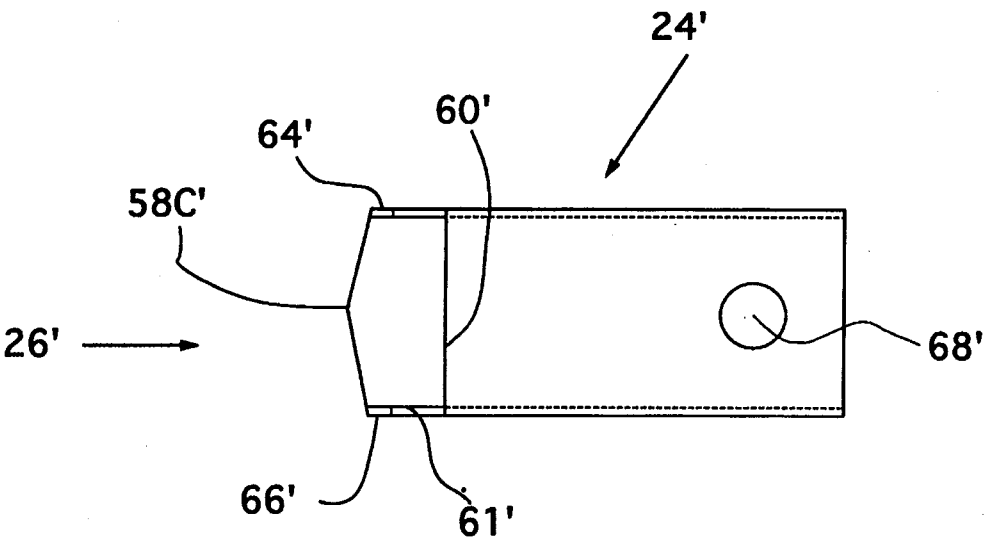
FIG. 8 is a top view of the blade member shown in FIGS. 6 and 7.
Figure 6:
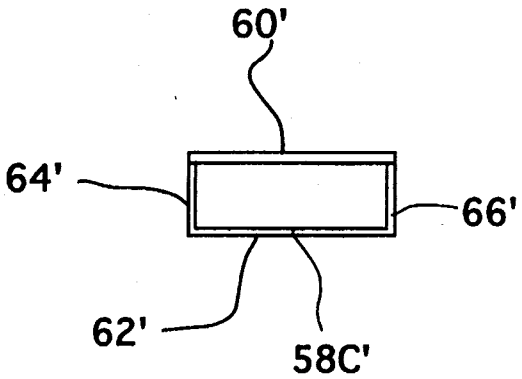
FIG. 6 is a front view of an alternative blade member that is utilized in the apparatus of the present invention.

It can be visualized that the blade member 24 can be manufactured with other configurations than as disclosed above. An alternative design is shown in FIGS. 6–8. The alternative design is intended to create a flap in the wall of the container rather than a complete void as with the blade member 24 embodiment shown in FIGS. 3–5. FIGS. 6 and 7 show that the cutting edge 26' of this embodiment is defined by connected linear sides, but two of the sides are only connected to one side. Specifically, cutting edge vertical sides 64', 66' are connected only to cutting edge bottom side 62'. The top side 60' of this blade member 24' is recessed (see FIG. 8) and thus, performs no cutting function. As a result of the form of this cutting edge 26', a U-shaped cut is made in the wall of the container.

As with the previously described embodiment, the bottom side 62' is formed with a linear convexity so as to present the same form of leading point 58C'. Vertical sides 64', 66' slant upwardly and rearwardly (note FIG. 7) to a plateau 61' below the plane of the surface of the top side 60'. This presents an angled edge 26' that produces the appropriate slicing action through the container wall. The top and bottom sides 60', 62', respectively, have holes 68' to similarly receive the projections 70 on the drive blocks 28.

It can be visualized that the blade member 24 may be made with other configurations. A variety of geometrical shapes can be employed to perform the appropriate function while having a related bore 32 to provide a pathway for the item 12 into the closed container following formation of the entrance point. The chosen shape is generally recognized to be a function of the shape of the item 12 to be inserted.

Figure 9:
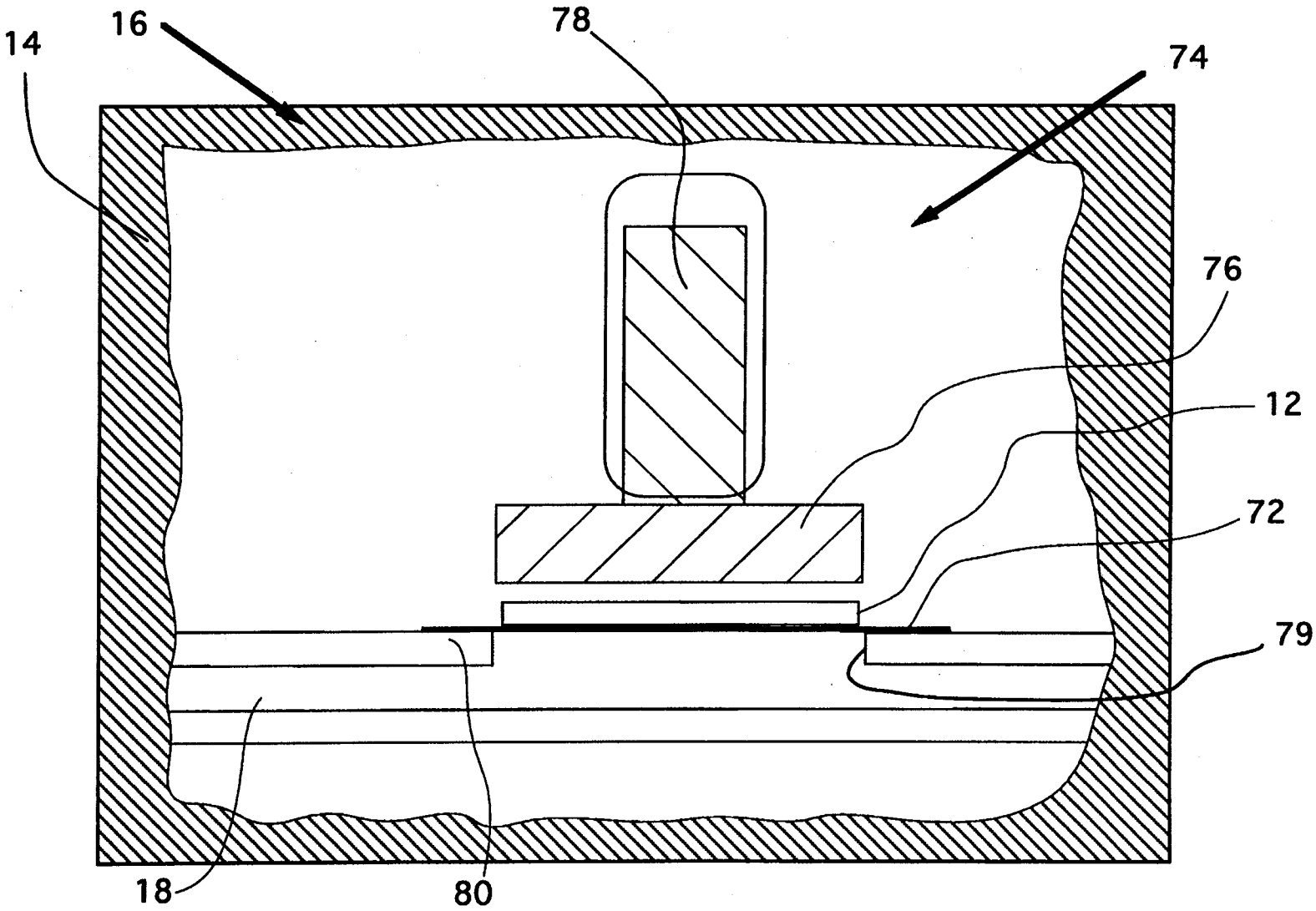
FIG. 9 is a view in modified cross-section of a portion of the body of the present invention, showing an alternative feed mechanism in a preparatory mode prior to detaching an item from the carrier web.

An alternative feed mechanism 16 is illustrated in FIG. 9. This form of feed mechanism 16 operates in a setting where items 12 are adhered to a carrier web 72 in adjacent relation, with each item being advanced to a position where the feed mechanism 16 operates to detach the item (either with or without its contiguous web portion) in preparation for delivery through the delivery passage 18.

As illustrated in the particular view of FIG. 9, the carrier web 72 with items 12 adhered thereon is being advanced in a direction normal to the plane of the figure and toward the viewer. The feed mechanism 16 in this embodiment comprises a punch assembly 74 formed of a punch block 76 driven by a solenoid 78. The punch assembly 74 is positioned within the body 14 directly above a portion of the delivery passage 18. An opening 79 is formed in the shell 80 of the delivery passage 18 that substantially matches the shape of the item 12. Likewise, the punch block 76 is fashioned to be of substantially the same shape and thus fits conveniently but without interference into the opening 79.

Figure 10:
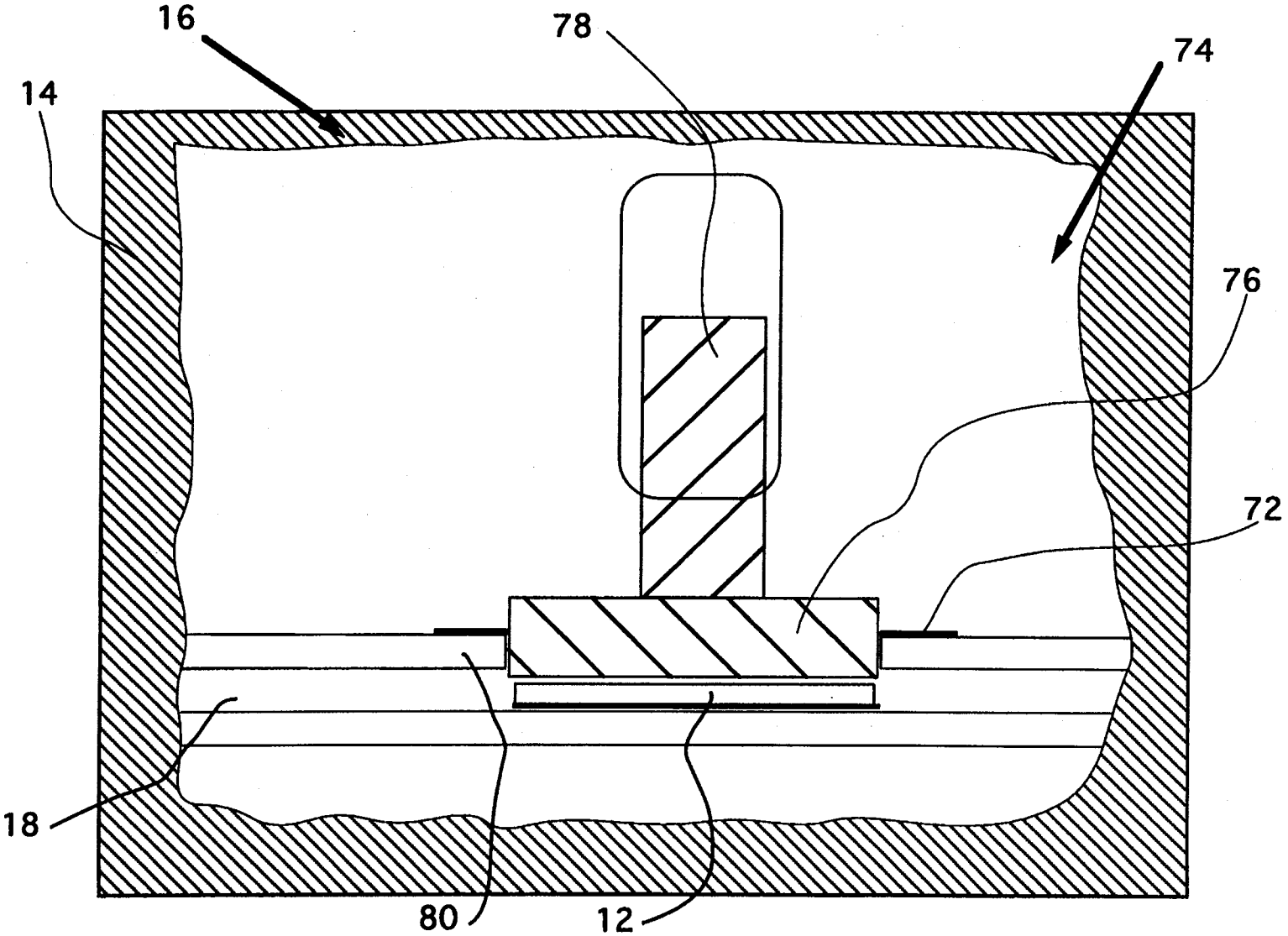
FIG. 10 is a view in modified cross-section similar to FIG. 9, showing the alternative feed mechanism of FIG. 9 in an actuated mode after driving the item to the delivery passage.

The carrier web 72 is advanced through the body 18 along a feed table, preferably with the use of feed rolls (not shown). When an item 12 is positioned directly above the delivery passage 18, the solenoid 78 is energized to drive the punch block 76 against the item to punch the item and its attached web portion from the body of the carrier web 72. With this action, the punch block 76 accelerates into the cooperating opening 79 and, in its extended position as shown in FIG. 10, forms a portion of the top wall of the delivery passage 18. The delivery passage 18 is thus substantially integrally sealed to prevent leakage or deflection of any air utilized to propel the item down the delivery passage 18 or to drive a delivery mechanism 20 to perform the propelling action.

Figure 16:
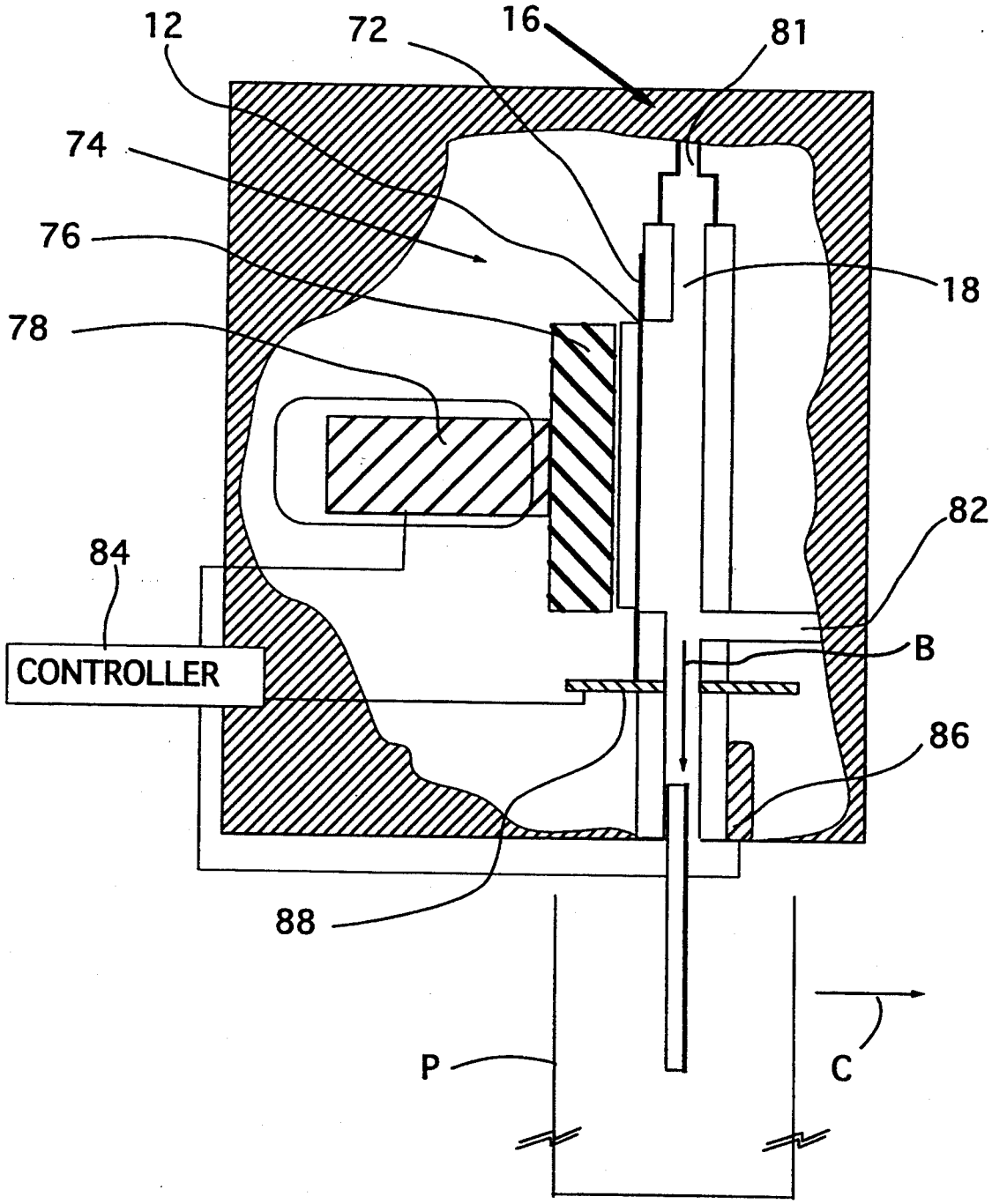
FIG. 16 is a view in modified cross-section of an alternative embodiment of the present invention used to insert an item by falling (or if desired, with pneumatic-assisted movement) into an open container situated below, the feed mechanism thereof preparing to deliver an item into the delivery passage.
Figure 17:
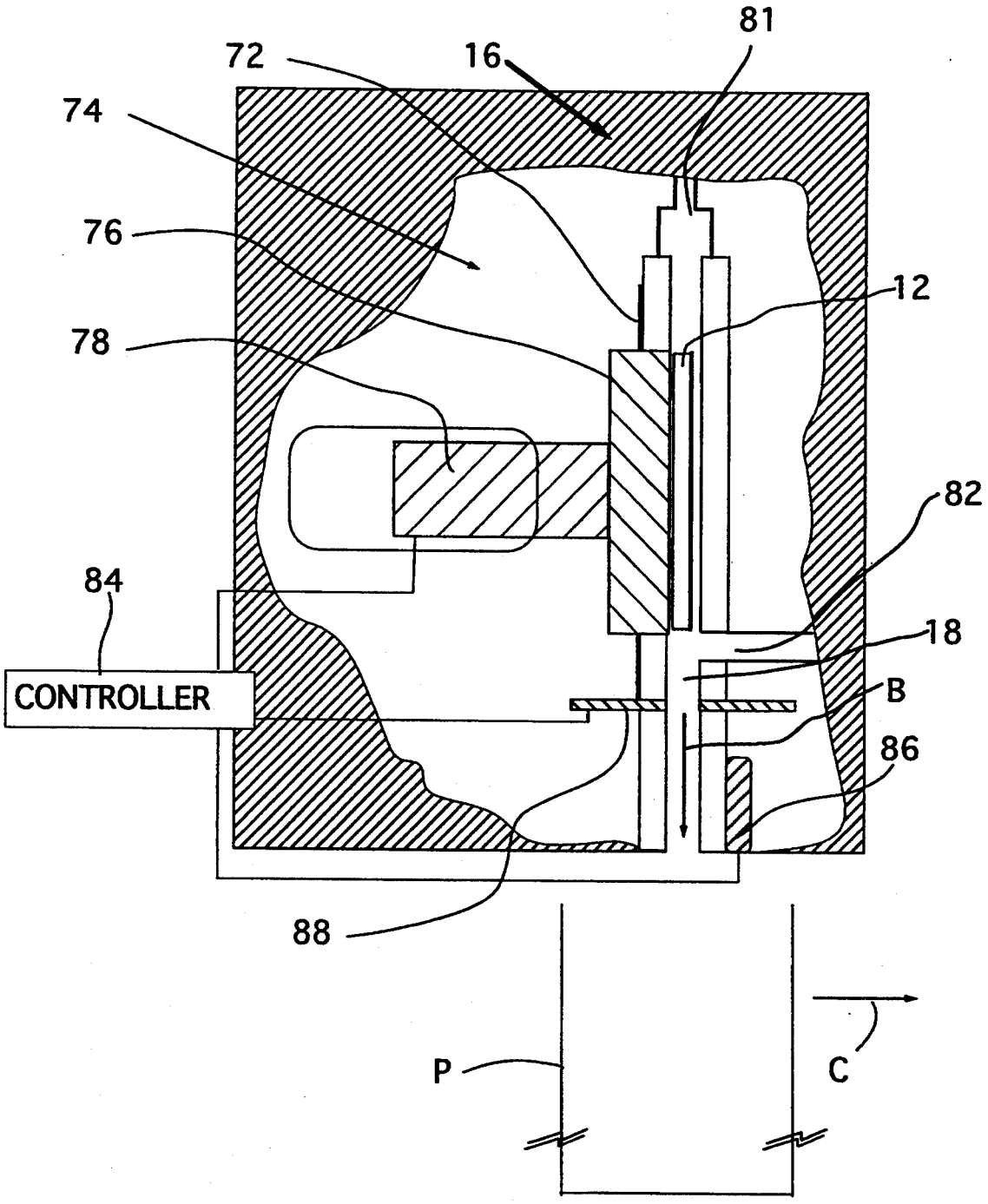
FIG. 17 is a view in modified cross-section of the alternate embodiment of FIG. 16, the feed mechanism thereof having delivered an item into the delivery passage.

FIGS. 16 and 17 illustrate the same feed mechanism 16 in a variant of the invention that is utilized to supply items 12 into open container P along a production line. This illustrates the versatility of the various components of the inventive insertion apparatus 10 to operate in a variety of operational environments. In this setting, the delivery of the items 12 is accomplished in a substantially vertical manner as the item drops as shown by action arrow B into a container P below traveling along a feed line in accordance with action arrow C.

As similarly described above, the carrier web 72 is advanced in a plane normal of the figure and toward the viewer. The punch assembly 74 is positioned directly adjacent a portion of the delivery passage 18. The punch block 76 is propelled by the associated solenoid 78 to drive the item 12 into the delivery passage 18 as shown in FIG. 17. When the item 12 and its associated web portion is punched from the web 72, and is punched into the delivery passage 18, the item 12 is positioned to fall by gravity into the container positioned below.

In view of the contemplation of this variant being utilized in a production line setting, it is necessary to adapt the variant for high speed use. Accordingly, though it is contemplated that the item 12 falls by gravity into the carton below, it is desirable to employ a gravity-assist mechanism in order to increase operational speed. The most convenient gravity-assist mechanism involves the use of a burst of compressed air supplied simultaneously to the delivery passage 18 as the item 12 is stripped from the carrier web 72 and presented therein. To facilitate this operation, a pneumatic conduit 81 is incorporated to be in fluid communication with the delivery passage 18. A side port 82 is provided along a wall of the delivery passage 18 to exhaust a portion of the gas and prevent a damaging blast force from exiting the end of the delivery passage 18 into the container P below.

To further facilitate high speed operation, a controller 84 (illustrated schematically) is provided to optimize the operation of the delivery procedure. It is contemplated here that the controller 84 be a separate unit whose only function is to control the delivery procedure or, alternatively, the control functions may be incorporated into the controller of the overall packaging line operation. The controller 84 cooperates with the punch assembly 74, the air source, and appropriate sensors to coordinate the timing necessary for efficient delivery operation.

A sensor 86 is preferably positioned adjacent the exit point of the delivery passage 18 to detect the position of the containers P traveling along the production line. The sensor 86 may take the form of a photocell, an ultrasonic detector, or other equivalent detecting device. When the sensor 86 detects the presence of a passing container, the appropriate signal is directed to the punch assembly 74 to punch an item 12 from the carrier web 72 into the delivery passage 18. Simultaneously, a signal is sent to the air source to supply a burst of compressed air to force the item 12 down the delivery passage 18 into the container P below.

An item sensor 88 is positioned along the delivery passage 18 below the position of the punch assembly 74. The item sensor 88 operates to detect the item 12 as it passes thereby in its travel toward the container P. The item sensor 88 signals the controller 84 that the delivery passage 18 is clear. The controller 84 then signals the punch assembly 74 to deenergize the solenoid 78 and withdraw the punch block 76 to its home position. Also, the controller 84 provides the appropriate signal to advance the carrier web 72 to present the next successive item 12 thereon to be positioned in readiness for propulsion into the delivery passage 18. The controller 84 may also perform the function of calculating the item velocity to properly adjust the air pressure for the next succeeding item if necessary.

Figure 11:
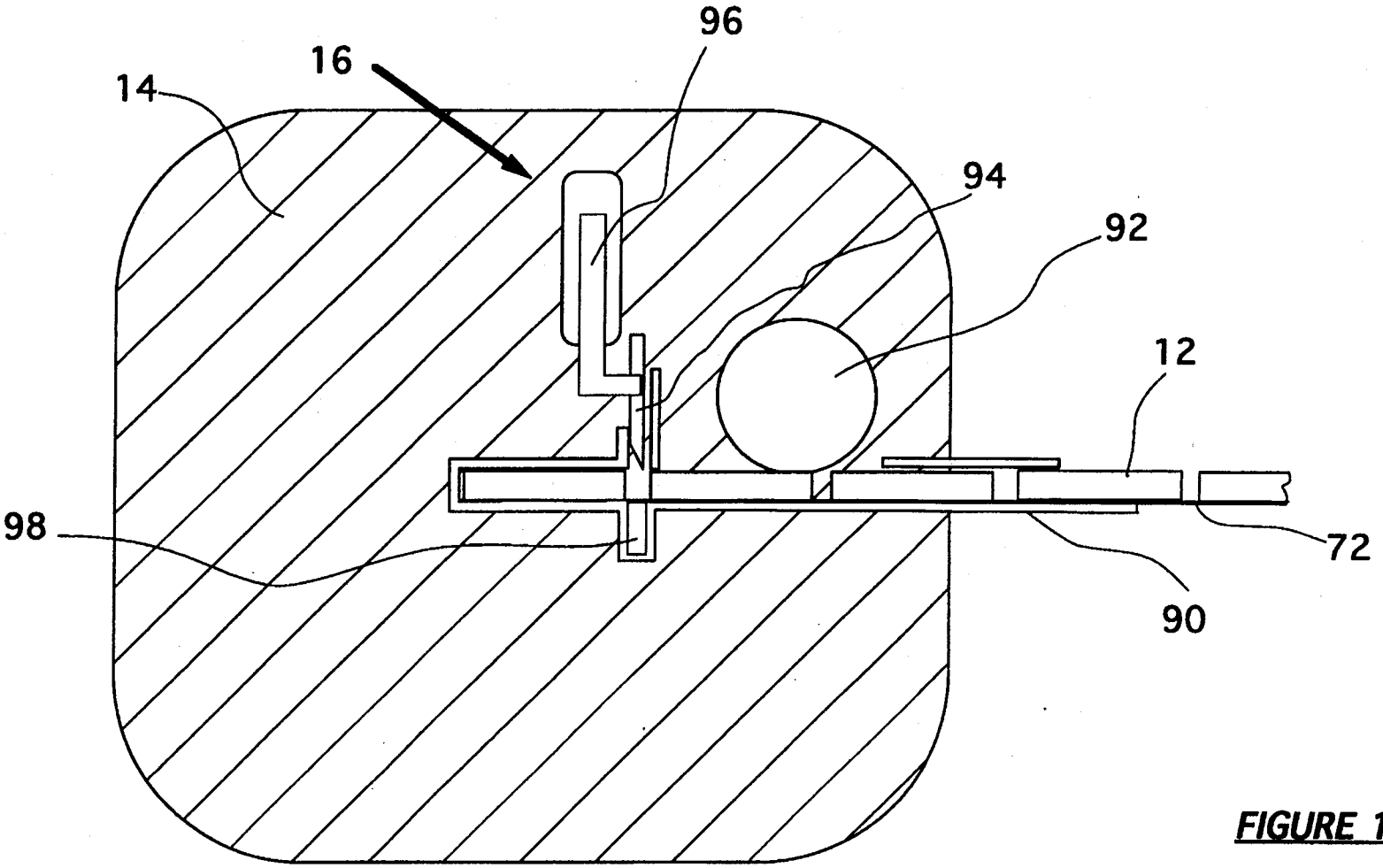
FIG. 11 is a view of the present invention in cross-section, showing an additional alternative embodiment of the feed mechanism, an item having been rolled into place in the delivery passage with a knife element in preparation for detaching the item from the carrier web.

Returning to the working environment associated with closed containers, FIG. 11 shows another embodiment of the feed mechanism 16. This view is a lateral cross-sectional view showing an item feed supply similar to that of FIGS. 9 and 10. More particularly, items 12 are adhered to a carrier web 72 in adjacent relation. The carrier web 72 is advanced on a feed table 90 through the side of the body 14 of the insertion apparatus 10. A feed roller 92 is rotatably driven to frictionally engage the items 12 to assist in directing and feeding the items with their associated carrier web 72 to the delivery passage 18 (obscured by an already-in-position item 12 in FIG. 11).

With this embodiment of feed mechanism 16, when the item 12 is properly positioned within the delivery passage 18, a cutting knife 94 is driven downwardly by a solenoid 96 to sever the carrier web 72 between the item 12 in the delivery passage 18 and the next succeeding item. A blade receiving area 98 extends below the plane of the feed table 90 to allow the cutting knife 94 to pass through and beyond the carrier web 72. In this position, the cutting knife 94 forms a portion of the side wall of the delivery passage 18. The cutting knife 94 is thus located to provide the same advantageous benefits as the punch block 76 described above. The delivery mechanism 20 then operates in the same manner to propel the item through the delivery passage 18.

As mentioned above, the blade member 24 is desirably utilized to form an entrance point in containers having thin walls. It is recognized that other types of merchandising containers are formed with relatively thick walls and/or are formed with denser, more durable plastic. In this event, it may be necessary to substitute for the blade member 24 an implement more suited to forming an entrance point in these types of containers. The embodiment of the inventive apparatus 10 illustrated in FIGS. 12–14 is designed to operate in this particular environment.

Figure 12:
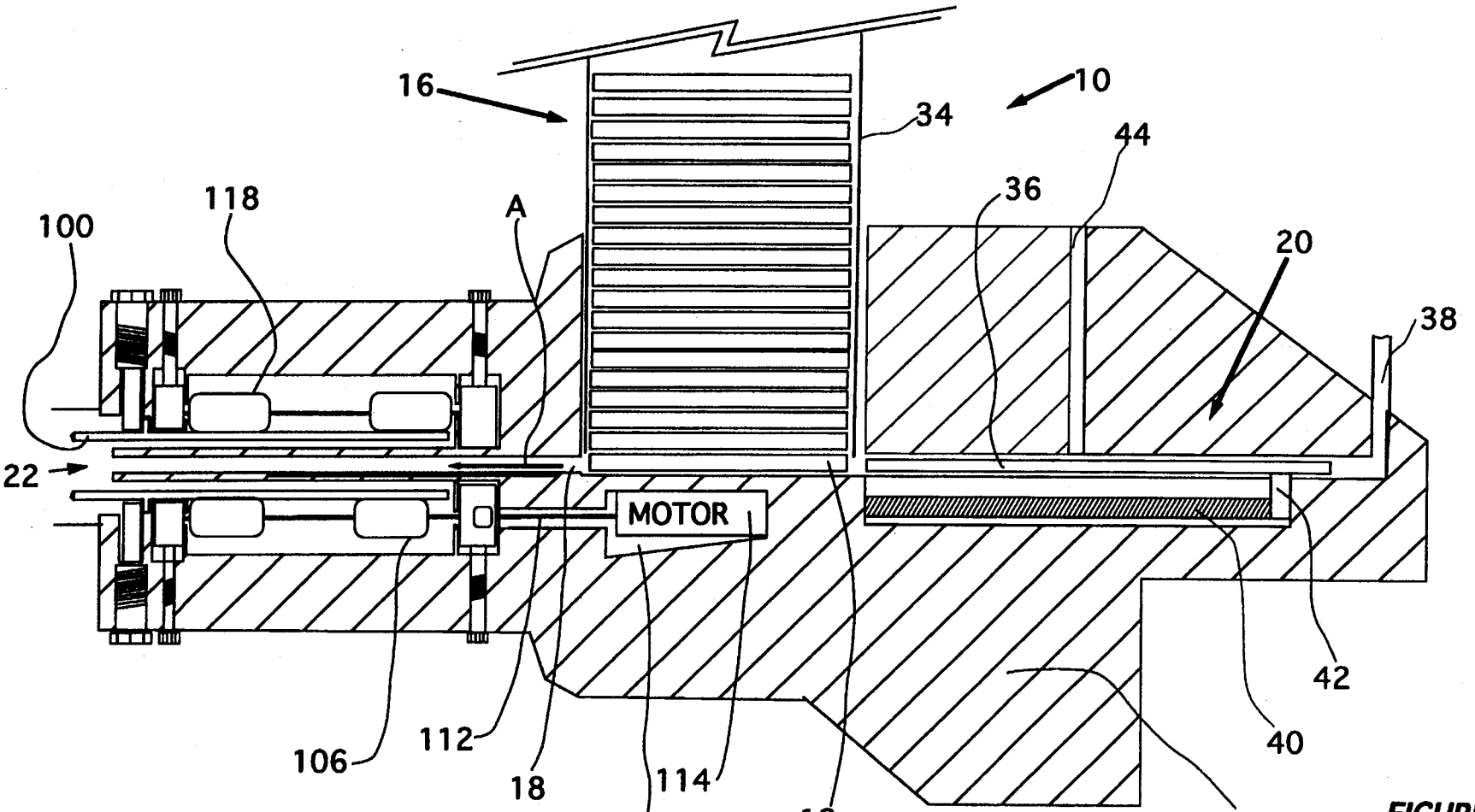
FIG. 12 is a cross-sectional view similar to FIG. 1, but showing a rotary member with a cutting element on its leading edge as an alternative implement for forming an entrance point in the wall of the closed container.

With reference to FIG. 12, the embodiment shows a feed mechanism 16 and a delivery mechanism 20 similar to that shown in FIG. 1 (the magazine 34 and the ram 36, respectively). The function of these components is exactly the same as with the earlier described embodiment. Thus, reference is made to the earlier discussion for instruction on the operation of these components and the disposition of the plug cut from the container wall. The specific focus here is with the alternative implement utilized to form the entrance point into the interior of the closed container.

Figure 13:
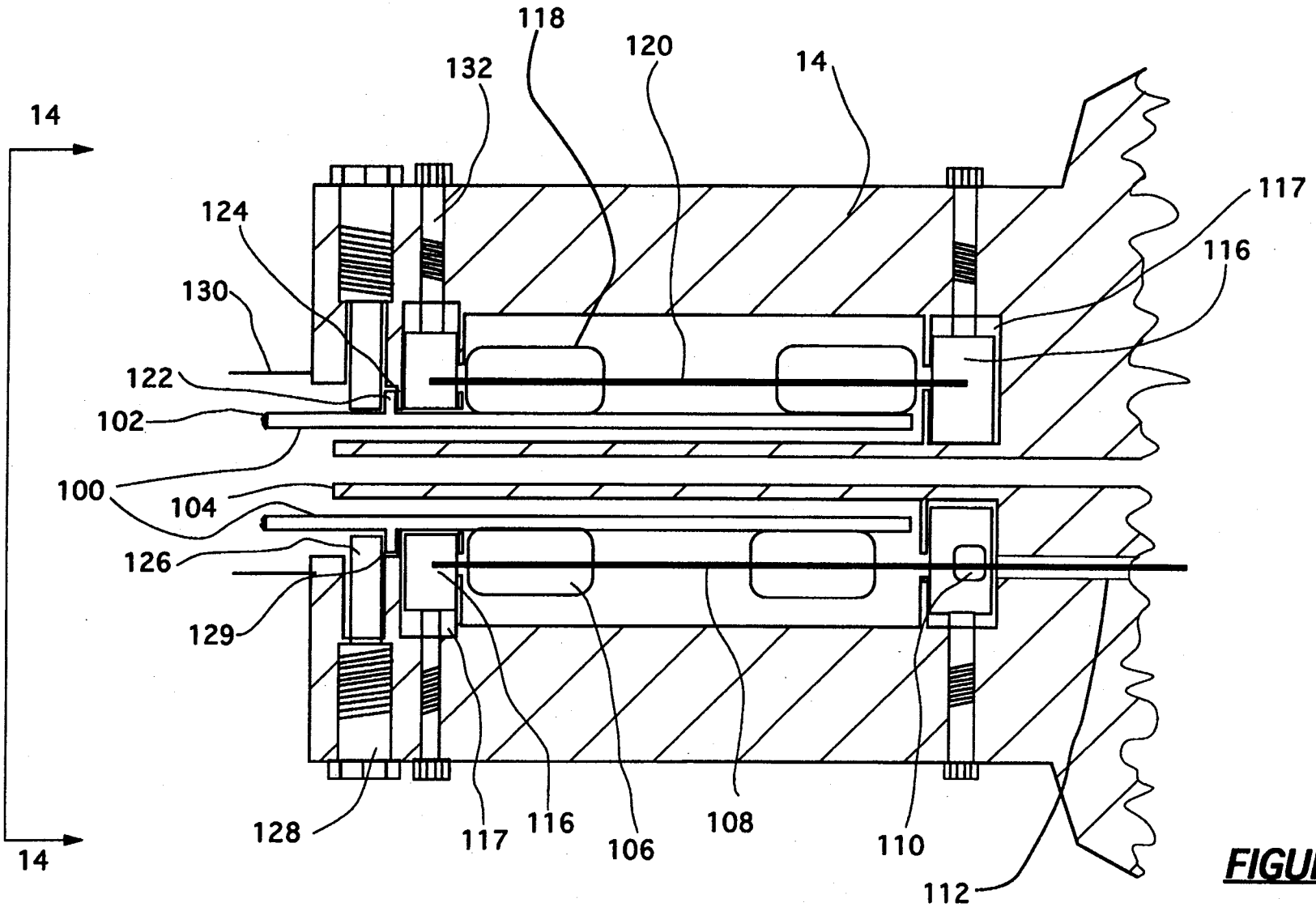
FIG. 13 is an enlarged view of the rotary member shown in FIG. 12, along with its cooperating components, taken along lines 13—13 of FIG. 14.
Figure 14:
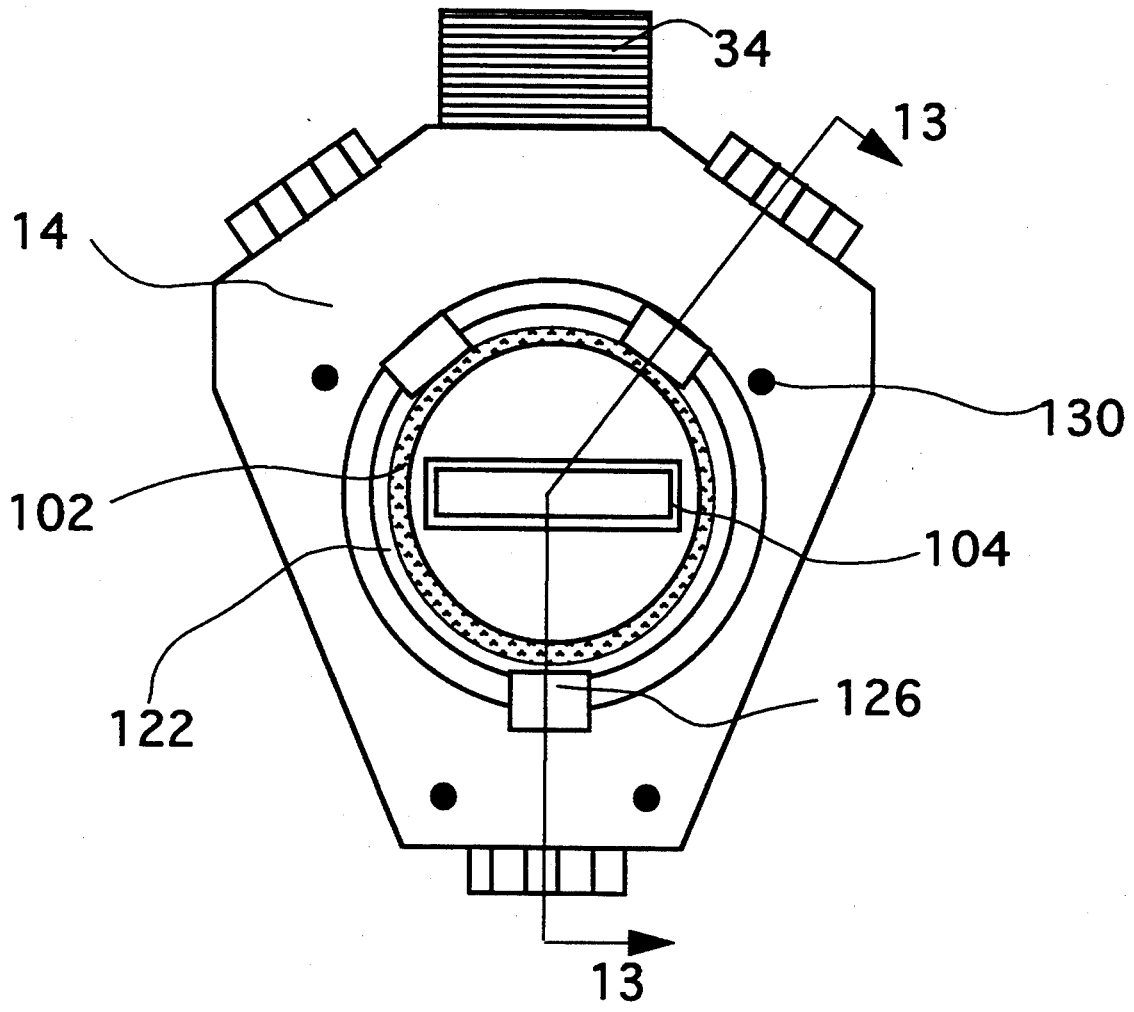
FIG. 14 is a view of the front face of the embodiment of the present invention utilizing the rotary member, taken along lines 14—14 of FIG. 13.

The preferred implement in this setting is a rotary cutter 100 as best seen in the enlarged view of FIG. 13. The cutter 100 has a leading edge 102 formed for a cutting function with saw-teeth or cutting abrasives. The cutter 100 surrounds the shell 104 that defines the outer end of the delivery passage 18.

In the preferred embodiment of this variant, the cutter 100 is driven to rotate by a pair of drive wheels 106 that engage the outer periphery of the cutter with frictional contact. The drive wheels 106 are supported by a common support shaft 108 which, through a coupling 110, is connected to a drive shaft 112 driven by a motor 114 (See FIG. 12). The motor 114 is situated in a retention cavity 115 that is configured to accommodate shifting when removal of the rotary cutter 100 is necessary. The motor 114 drives the contact wheels 106 to rotate about the support shaft 108 in a spatially fixed position and, through the frictional engagement, the cutter 100 is driven to rotate to promote its cutting function.

One end of the support shaft 108 is mounted in a cooperating holder block 116 and the coupling 110 connecting the support shaft to the drive shaft 112 is likewise mounted in a similar holder block. The mounting of the shaft 106 is effected using the appropriate means, such as bearings (not shown), to allow rotary operation. The holder blocks 116 are each received within retaining cavity 117 to also accommodate movement to allow removal of the rotary cutter 100, as will be more fully detailed below.

A greater or lesser number of drive wheels 106 may be used to rotate the cutter 100. It is also within the scope of the invention to utilize multiple sets of drive wheels 106 positioned in opposing relation to create the proper symmetry.

In order to ensure that the cutter 100 is maintained in a spatially fixed position during operation, a pair of retention wheels 118 are provided at a position opposing the position of the drive wheels 106. The retention wheels 118 are supported by a common support axle 120 rotatably mounted in opposing holder blocks 116, also with rotary operation assisting means such as bearings (not shown). These holder blocks 116 are also received in similarly configured retaining cavities 117 to accommodate movement. The retention wheels 118 thus provide a force in opposition to that applied by the drive wheels 106 and substantially prevents the central axis of the rotary cutter 100 from moving within the body 14.

It is recognized that more than one support axle 120 may be employed and each axle may have a lesser or greater number of retention wheels 118. The positioning of the retention wheels 118 is a function of the number utilized for proper balance.

In addition, in order to maintain the cutter 100 in a substantially fixed axial position, an annular flange 122 is formed on the outer periphery of the cutter. The flange 122 rests against a shoulder 124 formed within the body 14 and is prevented from advancing axially out of the body by an end portion 126 of a shoulder bolt 128. The shoulder 124 and end portion 126 of the shoulder bolt 128 thus cooperate to form a retaining slot 129 within the body 14 for the annular flange 122. It can thus be seen with the various retention mechanisms that the rotary cutter 100 rotates to perform its cutting function in a substantially fixed position.

It can be appreciated that, without stability, the initial engagement between the rotary cutter 100 and the wall of the container tends to force the body 14 to skate along the outer surface of the wall. Thus, there is a need to ensure that the body 14 is securely positioned adjacent the wall when the cutting procedure is started. To promote this objective, the body 14 is preferably formed with a plurality of piercing needles 130 located at positions adjacent the cutter. Accordingly, when the insertion apparatus 10 is initially brought into contact with the container, the piercing needles 130 penetrate the wall of the container to obtain a firm grip and prevent the body 14 from skating thereacross when the rotary cutter 100 is engaged.

As with the embodiment utilizing the blade member 24 described above, it is contemplated that the rotary cutter 100 be removable for repair or replacement. More specifically, the shoulder bolts 128 are threadably removable from the body 14 to provide access to the rotary cutter 100. Retention bolts 132 are connected to the holder blocks 116 with a ball-and-socket coupling (not shown) and are also threadably movable with respect to the body 14. Thus, when the retention bolts 132 are retracted, the holder blocks 116 slide within the respective cavities 117 to allow the drive wheels 106 and the retention wheels 118 to swing away from contact with the cutter 100. The cutter 100 is then pulled forward and extracted from the body. The ease of removability is an additional attraction that is provided by the inventive apparatus 10 to permit unskilled laborers to easily utilize the invention.

Figure 15:
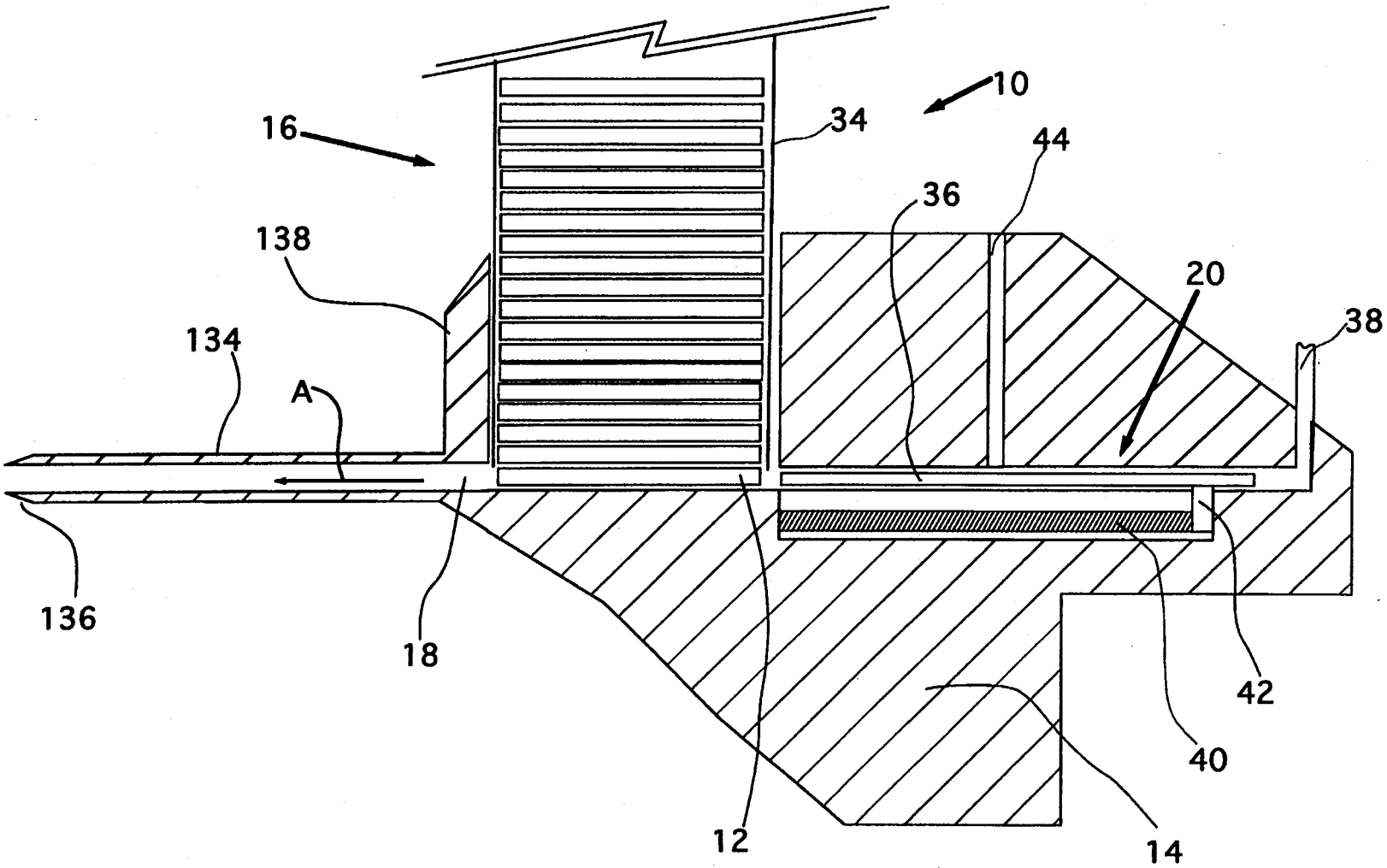
FIG. 15 is a side view in cross-section showing as an alternative embodiment a projection extending from the front face of the body and utilized to insert items into a closed container having a pre-formed slit or opening.

Various embodiments of the invention described above are directed to use with closed containers that require the formation of an entrance point for insertion of an item 12. Those skilled in the packaging art recognize that some containers are formed in such a manner that an opening exists through which an item 12 can be introduced. With this in mind, the present invention contemplates an embodiment in which it is not necessary to incorporate a means for forming an entrance point in the closed container. Rather, this embodiment utilizes a means for accessing the interior of the closed container through the pre-formed slit or opening. This embodiment is illustrated in FIG. 15.

The feed mechanism 16 and delivery mechanism 20 is contemplated as being the same as those described above in the preferred embodiment shown in FIG. 1. More specifically, a magazine 34 is utilized to introduce items 12 from a stack to a delivery passage 18 and a ram 36 driven by air pressure propels the item through the delivery passage. In this embodiment, a projection 134 with a tapered tip 136 extends from the front face 138 of the body 14. The delivery passage 18 extends through the projection 134 to form a continuous pathway for the item 12. This embodiment is easily used by sliding the tip 136 into the pre-formed slit or opening in the container. It is contemplated that this embodiment be used with packages such as cartons that contain cigarettes which are closed by folding panels in overlap relation. With this type of package, there is an area between the folded panels in which the tip 136 of the projection 134 is slid to access the interior thereof. Alternatively, this embodiment can be utilized for product cartons that have been manufactured with a slit specifically for the purpose of inserting this device.

In summary, numerous benefits result from practicing the concepts of the present invention. The insertion apparatus 10 is designed, with its various embodiments, with a means to access the interior of a closed container. For those containers that require the formation of an entrance point through which an item 12 is inserted, the apparatus 10 incorporates a blade member 24 to operate on thin-wall containers or a rotary cutter 100 to operate on thick-wall containers. The blade member 24 or rotary cutter 100 are driven in the appropriate manner to form the opening. For those containers with pre-formed openings or slots, the apparatus 10 is formed with a projection 134 that is slid into the pre-formed slot or opening to obtain access into the interior and facilitate the insertion of the item 12.

The body 14 of the insertion apparatus 10 is formed with a delivery passage 18 into which items 12 are fed by a feed mechanism 16 such as a magazine 34. A delivery mechanism 20, such as an air-powered ram 36 propels the item 12 through the delivery passage 18 and into the closed container. The blade member 24 and the rotary cutter 100 are removable for repair or replacement. The various embodiments of the apparatus 10 are contemplated for use both in a packaging line environment that requires high speed operation and with hand-held units easily manipulated by unskilled laborers at a retail site or distribution center. It is thus contemplated that the invention is a pioneering concept which performs a valuable function that heretofore has been unattainable in these operational settings.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An apparatus for inserting an item into a closed container without materially disturbing the contents of said container, comprising:

a body;

means associated with said body for accessing the interior of said closed container through a wall thereof without materially disturbing the contents of said container;

a delivery passage associated with said accessing means;

means for feeding said item to said delivery passage; and means for delivering said item from said delivery passage into said container.

2. The apparatus as in claim 1, wherein said accessing means comprises an implement for forming an entrance point into said interior of said closed container.

3. The apparatus as in claim 2, wherein said implement comprises a blade member.

4. The apparatus as in claim 3, wherein said blade member is defined by a cutting edge configured to form a substantially complete void through a wall of said container.

5. The apparatus as in claim 4, wherein said cutting edge is defined by a plurality of connected linear sides, and a first two opposing sides of said cutting edge are longer than a second two opposing sides of said cutting edge.

6. The apparatus as in claim 5, wherein said connected linear sides cooperate to present a plurality of points for initial contact between said blade member and said wall of said container.

7. The apparatus as in claim 6, wherein at least two of said points are in different longitudinal horizontal and vertical planes with respect to each other.

8. The apparatus as in claim 5, wherein a first of said longer sides tapers inwardly at the same angle from opposing outer points to meet at a common point along a central longitudinal axis of said blade member and a second of said longer sides tapers outwardly at the same angle from opposing outer points to meet at a common point along said central longitudinal axis of said blade member.

9. The apparatus as in claim 3, wherein said blade member is defined by a cutting edge configured to form a flap through a wall of said container.

10. The apparatus as in claim 9, wherein said cutting edge is defined by a plurality of connected linear sides, and two of said linear sides are connected to only one linear side.

11. The apparatus as in claim 10, wherein said connected linear sides cooperate to present at least one point for initial contact between said blade member and said wall of said container.

12. The apparatus as in claim 3, wherein said blade member is selectively extendable to penetratingly engage a wall of said closed container.

13. The apparatus as in claim 12, wherein said blade member is removably coupled to a drive member.

14. The apparatus as in claim 13, wherein said blade member has at least one hole for receiving a cooperating projection on said drive member.

15. The apparatus as in claim 13, further including a removable retaining element for allowing access to said blade member and said drive member.

16. The apparatus as in claim 15, wherein said removable retaining element comprises opposing blocks attached to said body by removable connectors.

17. The apparatus as in claim 2, further including means for displacing said accessing means.

18. The apparatus as in claim 17, wherein said displacing means comprises pneumatic actuating means.

19. The apparatus as in claim 18, wherein said pneumatic actuating means comprises a conduit positioned in a chamber within said body and establishing fluid communication between a pneumatic source and a drive member associated with said blade member.

20. The apparatus as in claim 19, further including a relief passage associated with said chamber.

21. The apparatus as in claim 17, wherein said displacing means comprises electromechanical actuating means.

22. The apparatus as in claim 21, wherein said electromechanical actuating means comprises a solenoid element.

23. The apparatus as in claim 1, further including means for holding said body against said container.

24. The apparatus as in claim 23, wherein said holding means comprises suction means.

25. The apparatus as in claim 24, wherein said suction means comprises at least one surface cavity on said body, said cavity exposed to a wall of said container and in which negative pressure is applied.

26. The apparatus as in claim 25, wherein said at least one surface cavity receives a conduit establishing fluid communication between a suction source and said container wall.

27. The apparatus as in claim 1, wherein said feeding means comprises a vertical receptacle having a stack of items for disbursement.

28. The apparatus as in claim 1, wherein said feeding means comprises a movable carrier web on which a plurality of items are adhered in adjacent relation and a punch member for detaching said items from said carrier web.

29. The apparatus as in claim 28, wherein said punch member forms a portion of a side of said delivery passage after detaching an item from all or a portion of said web.

30. The apparatus as in claim 1, wherein said feeding means comprises a movable carrier web on which a plurality of items are adhered in adjacent relation and a cutting member for detaching said items from said carrier web.

31. The apparatus as in claim 30, wherein said cutting element forms a portion of a side of said delivery passage after detaching said item from all or a portion of said web.

32. The apparatus as in claim 1, wherein said delivering means comprises positive air pressure introduced into said delivery passage.

33. The apparatus as in claim 1, wherein said delivery means comprises a ram member displaceable within said delivery passage.

34. The apparatus as in claim 33, wherein positive air pressure is introduced into said delivery passage to cause displacement of said ram member.

35. The apparatus as in claim 33, wherein said ram member is driven by eletromechanical means.

36. The apparatus as in claim 35, wherein said electromechanical means comprises a solenoid element.

37. The apparatus as in claim 33, further including means for returning said ram member to a home position following delivery of a first item and in preparation for delivery of a next successive item.

38. The apparatus as in claim 37, wherein said returning means is a biasing spring.

39. The apparatus as in claim 2, wherein said implement comprises a rotary member having a cutting element on a leading edge thereof.

40. The apparatus as in claim 39, wherein said rotary member is received within an annular chamber surrounding said delivery passage.

41. The apparatus as in claim 39, further including means for rotatably driving said rotary member.

42. The apparatus as in claim 41, wherein said rotatable driving means comprises at least one contact wheel frictionally engaging said rotary member and driven to rotate by a motor.

43. The apparatus as in claim 39, further including means for holding said rotary member in place within said body.

44. The apparatus as in claim 43, wherein said holding means comprises means for retaining a central axis of said rotary member in a substantially fixed position.

45. The apparatus as in claim 44, wherein said central axis retaining means comprises at least one spatially fixed member that rotates about an axis non-coincident with the central axis of said rotary member.

46. The apparatus as in claim 45, wherein said at least one spatially fixed member comprises a retention wheel in opposed relation to said rotatable driving means.

47. The apparatus as in claim 43, wherein said holding means comprises means for retaining said rotary member in a substantially fixed axial position.

48. The apparatus as in claim 47, wherein said axial retaining means comprises an annular flange formed on an outer circumference of said rotary member and received within a slot formed with said body.

49. The apparatus as in claim 41, wherein said rotatable driving means comprises a motor with an associated shaft and a gear assembly associated with said shaft and said rotary member.

50. The apparatus as in claim 39, further including means for holding said body against said container.

51. The apparatus as in claim 50, wherein said holding means comprises at least one needle that pierces a wall of said container for retention.

52. The apparatus as in claim 1, wherein said accessing means comprises a projection extending from a front face of said body.

53. The apparatus as in claim 52, wherein said projection includes a rearwardly tapered tip.

* * * * *